United States Patent [19]

Kremar

[11] Patent Number: 4,905,925

[45] Date of Patent: Mar. 6, 1990

[54] REEL BAR LOADING MECHANISM WITH OUTWARDLY PIVOTING GUIDE RAILS

[75] Inventor: Djuro Kremar, N.D. Ile Perrot, Canada

[73] Assignee: Valmet-Dominion Inc., Lachine, Canada

[21] Appl. No.: 308,284

[22] Filed: Feb. 9, 1989

[51] Int. Cl.[4] ..... B65H 19/30; B65H 18/16

[52] U.S. Cl. ..... 242/65; 242/58.6

[58] Field of Search ..... 242/56 R, 58.6, 55, 242/65; 414/276, 279, 745, 748, 911

[56] References Cited

U.S. PATENT DOCUMENTS

| | | |
|---|---|---|
| 1,949,997 | 11/1931 | Fourness . |
| 2,508,566 | 5/1950 | Dunton . |
| 2,835,372 | 5/1958 | Biddison . |
| 2,989,262 | 6/1961 | Hornbostel . |
| 3,062,389 | 11/1962 | Hunter . |
| 3,239,155 | 3/1966 | Kinoshita . |
| 3,386,677 | 6/1968 | Becker . |
| 3,586,253 | 6/1971 | Gilbank . |
| 3,614,011 | 10/1971 | Karr . |
| 3,877,654 | 4/1975 | Randpalu et al. . |
| 4,179,330 | 12/1979 | Page . |
| 4,417,491 | 11/1983 | Uehara et al. . |
| 4,431,140 | 2/1984 | Tetro . |
| 4,634,068 | 1/1987 | Malkki et al. . |
| 4,744,526 | 5/1988 | Kremar . |
| 4,744,720 | 5/1988 | Kremar . |
| 4,778,122 | 10/1988 | Snygg ..... 242/65 X |

FOREIGN PATENT DOCUMENTS

| | | |
|---|---|---|
| 875820 | 7/1971 | Canada . |
| 960628 | 1/1975 | Canada . |
| 1009637 | 5/1977 | Canada . |
| 132933 | 10/1962 | U.S.S.R. . |

*Primary Examiner*—Stuart S. Levy
*Assistant Examiner*—Steven M. duBois
*Attorney, Agent, or Firm*—R. A. Eckersley

[57] ABSTRACT

A reel bar loading device is provided having sloping storage rails located above the driving roll. The storage rails are pivotally connected at their lower ends to second rails. The second rails have upper end portions, downwardly sloping portions and lower end portions. The second rails in a first position are in alignment with the first rails and provide a continuum of the track permitting the reel to descend the second rails into an awaiting transfer arm mechanism. The second rails are pivotal outwardly precluding movement of a reel from the first rails and allowing the transfer arm mechanism to move into a winding position. A pair of lowering arms engage the reel at the opposite ends of the reels adjacent to and inside of the second rails to control the descent of the reel over the second rails when the second rails are in their first position.

6 Claims, 3 Drawing Sheets

REEL BAR LOADING MECHANISM WITH OUTWARDLY PIVOTING GUIDE RAILS

FIELD OF THE INVENTION

The present invention relates to a reel loading device adapted to feed reels from upper supporting racks or rails onto transfer arms which move and support the reel in winding position in a paper making machine.

BACKGROUND OF THE INVENTION

A variety of different reel lowering devices for transferring a reel from a supporting rack for storing empty reel bars into a transfer means to move the reel bars into a winding position have been proposed and many such devices are currently in use. For example U.S. Pat. No. 1,949,997 issued Mar. 6, 1934 to Fourness describes a paper winder wherein empty cores are carried from a lower rack via a pair of arms and moved into winding position against a winding drum to form a roll of paper. The shaft of the paper core is transferred from grooves or slots in the arms transferring the core to the winding position into co-operating slots formed in a second pair of transfer arms that carry a finished or wound roll of paper into a second storage rack located above the storage rack for empty reels. This device provides for the loading and unloading of reels and wound paper rolls respectively from a winding position but is a relatively expensive and cumbersome piece of equipment.

U.S. Pat. No. 2,508,566 issued May 23, 1950 to Dunton describes a web roll backstand and provides for a transfer of a wound roll to an unwind station and removal of the cores. A pair of arms are used to make the transfer into the unreeling position and a second pair of arms are used to transfer the empty reel or core to a second storage position. Although this device is not a device for transferring empty reels into a transfer arm it does show the use of spaced arms to make the transfer of the roll into an operating position.

U.S. Pat. No. 2,989,262 issued June 20, 1961 to Hornbostel teaches the use of gravity to roll a plurality of empty cores and apply the cores one at a time from an inclined storage device into a loading position where they are picked up by a transfer arm and moved into winding position between a pair of winding drums. The mechanism for controlling the flow of empty cores down the relatively steep incline of the storage device leads to significant complications in this structure of the winder.

Yet another example of a reel loader is shown in U.S. Pat. No. 3,586,253 issued June 22, 1971 to Gilbank et al. In this device empty reels are loaded onto an upper rack formed by a pair of rails having an abutment stop at their lower ends so the empty reels move down the rails to the abutment stop. A pair of lifting and lowering arms are provided which lifts each empty reel over the abutment and permits it to roll to the opposite side thereof and then lowers the reel into the reel transfer device. The operation of the reel lowering arms in the arrangement requires lifting the reel over the abutment, transverse movement to direct the reel to the opposite side of the abutment and then lowering of the reel into the transfer device. The opposite side of the abutment in this case operates as a cam to hold the reel in position during the initial phases of lowering of the lowering arms so that there is a controlled movement of the reel along the lowering arms. Obviously the reciprocal motion of the arm during loading complicates the operation of the lowering arms in that they first must move upward to lift the reel bars above the abutment and then downward after the reel bars have moved along the arm to the opposite side of the abutment into a transfer position. U.S. Pat. No. 4,179,329 issued Dec. 18, 1979 to Page discloses an apparatus for handling web material that involves the use of lowering arms similar to that taught by Gilbank et al.

U.S. Pat. No. 3,877,654 issued Apr. 15, 1975 to Randpalu et al utilizes transfer arms as a transfer device in the normal manner to move a reel bar into winding position and also as a lowering mechanism. The transfer arms are extended so that the clamp may move along the arms to an upper position to receive reels located on the storage rack thereabove. Clearly, such extension of the transfer arms requires a controlled movement of the reels along the storage rack to permit the transfer arms to rotate and requires a more elaborate clamping mechanism which is transported along the transfer arms.

In my U.S. Pat. No. 4,744,526 issued May 17, 1988 there is disclosed a reel bar lowering device where the ends of the rails are pivotally connected about a horizontal axis to allow the rail ends to collapse lowering the reel into an initial winding position. In my U.S. Pat. No. 4,744,720 issued May 17, 1988 there is disclosed a reel bar loader device having a pair of lowering arms onto which the reel bars are loaded one at a time. The lowering arms pivot about a horizontal axis from an upper position adapted to receive a reel bar on a supporting surface thereof to a lower transfer position while the reel bar rolls along the length of the surface into contact with an abutment on the arms. The reel lowering arms provide a cam stop that moves into stopping position to stop movement of reel bars into a loading position when the lowering arms are not in their upper position.

Another example of a lowering device including arms that pivot about a horizontal axis is disclosed in Russian Pat. No. 132,933 dated 1959. In this document there is shown a lowering arm over which an elongated bar rolls into a working position where the arms are adapted to load the next bar when the arms rise from a lower position into an upper position.

Still yet another example of a lowering device where a flask is lowered into a transfer device is disclosed in U.S. Pat. No. 3,062,389 issued Nov. 6, 1987 to Hunter. In this device the flask is lowered into the jaws of a transfer station prior to the flask being moved into a lower rack. The lowering arms pivot about a horizontal axis from an upper position prohibiting the flask from moving off the ends of the support rails to a lower position where the flask roll down the lowering arm into the awaiting transfer station. The rate of decent of the flask is a function of the curvature of the lowering arm and is not controlled by any positive means. As a result, the movement of the flask is arrested by the transfer jaws. The momentum associated with this movement increases as the weight of the flask increases thereby placing more of a jarring load on the jaws.

It is also known in a reel lifting device that lifts empty reels onto overhead rails to pivotally connect ends of the rails to the rails themselves where by the ends of the rails pivot outwardly about respective vertical axes. In this arrangement, the rails slope downwardly away from the lifting arm. The lifting arm raises the reel above the rails, the ends of the rails then pivot inwardly to be located below the reels. The lifting arm then lowers the reel onto the ends of the rail whereby the reel is free to roll down the rails away from the lifting arm. While the above device provides for outwardly pivoting rail ends, the device still requires the use of a lifting arm that pivots about a horizontal axis and is designed to carry the entire weight of the empty reel. Further, while I have modified the reel bar lifter design for use in a lowering device, such a device still requires the use of a lifting and lowering arm that first lifts the reel off the ends of the rails, and then lowers the reel into winding position. Such lifting and lowering devices must carry the entire weight of the reel during the lifting or lowering which becomes more critical for larger and heavier reels.

The above reel lowering device mechanisms either require lifting and lowering of the reel in a lowering arm mechanism or they require that the reel be lowered by pivoting arms that pivot about a horizontal axis. However when heavy reels in the order of 12,000 kg are used with these reel lowering arms to control lowering of the reel from the support rails down into the transfer arms the safety factor in using these arms becomes more critical since failure of the lowering arm may result in collapse of the lowering device and free fall of the reel. Should the reel bar lowering arms not be able to cope with the weight of the reel and fail, the lowering arm may collapse downwardly dropping the reel. Thus the use of heavier reels may adversely effect the safety factor.

BRIEF DESCRIPTION OF THE INVENTION

It is an object of the present invention to provide a mechanism for permitting lowering the empty reels from the storage racks or rails into transfer arms wherein the reel moves along a continual track into the transfer arm.

It is a further object of the present invention to provide a structure wherein the reel descends into the transfer arm over a continuous track and where this decent is controlled.

It is another object of the invention to provide a mechanism for lowering of a reel into winding position where a continuous rail over which the reel descends thereby precluding a free fall of the reel.

In accordance with one aspect of the present invention there is provided a reel bar loader for loading a reel into winding position in a paper making machine. The reel bar loader comprises first rail means including a pair of parallel first rails each of which gently slopes downwardly from one end towards the other end thereof and which together provide a track for carrying at least one reel. The reel bar loader includes second rail means including a pair of second rails each having an upper end portion, a downwardly sloping portion and a lower end portion. Each of the upper end portions of the second rails are pivotally connected about a vertical axis to the other end of a corresponding one of the first rails. There is provided a transfer arm means pivotally movable between a first loaded position adjacent the lower end portions of the second rails for accepting the reel from the lower end portions of the second rails and a second loaded position positioning the reel in a winding position remote from the lower end portions of the second rails. Means are provided for controlling pivotal movement of the second rails in an outward direction away from one another from a first position, where the second rails are parallel to one another and are in alignment with the first rails providing a continuum of the track and allowing movement of the reel over the second rails into the transfer arm means, to a second position, where the second rails are in non-alignment with the first rails such that the lower end portions thereof are positioned remote of the transfer arm means precluding movement of a further reel over the second rails and permitting movement of the transfer arm means into the second loaded position which movement of the transfer arm means in loaded condition would otherwise be prohibited by the second rails when in their first position. There is also provided means for controlling the descent, of the reel as the reel moves over the second rails into the transfer arm means.

Advantage is found with the present invention in that by providing downwardly sloping second rails that pivot about respective vertical axes, the second rails take a part of the load of the reel as it descends the rails without the whole load being carried by a lowering arm. Further, since the second rails pivot about respective vertical axes, should the mechanism lowering the reels fail to function properly, the position of the second rails is not effected and the second rails continue to provide a track over which the reel descends.

The means for controlling pivotal movement of the second rails preferably comprises a hydraulic piston and cylinder for each second rail and corresponding pivotally connected first rail. The cylinder is pivotally secured to an outside surface of the first rail with the piston being pivotally secured to an outside surface of the second rail. Contraction of the piston causes the second rail to pivot outwardly about its vertical axis at an angle of about 90 degrees with respect to the first rail.

The means for controlling the decent of the reel over the second rail means preferably comprises a pair of lowering arms positionable below opposing ends of the reel adjacent to and inside of the second rails. The lowering arms move in unison to lower the reel over the second rails into the transfer arm means.

BRIEF DESCRIPTION OF THE DRAWINGS

For a better understanding of the nature and objects of the present invention reference may be had by way of example to the accompanying diagrammatic drawings in which.

DESCRIPTION OF THE PREFERRED EMBODIMENTS

Figure 1:
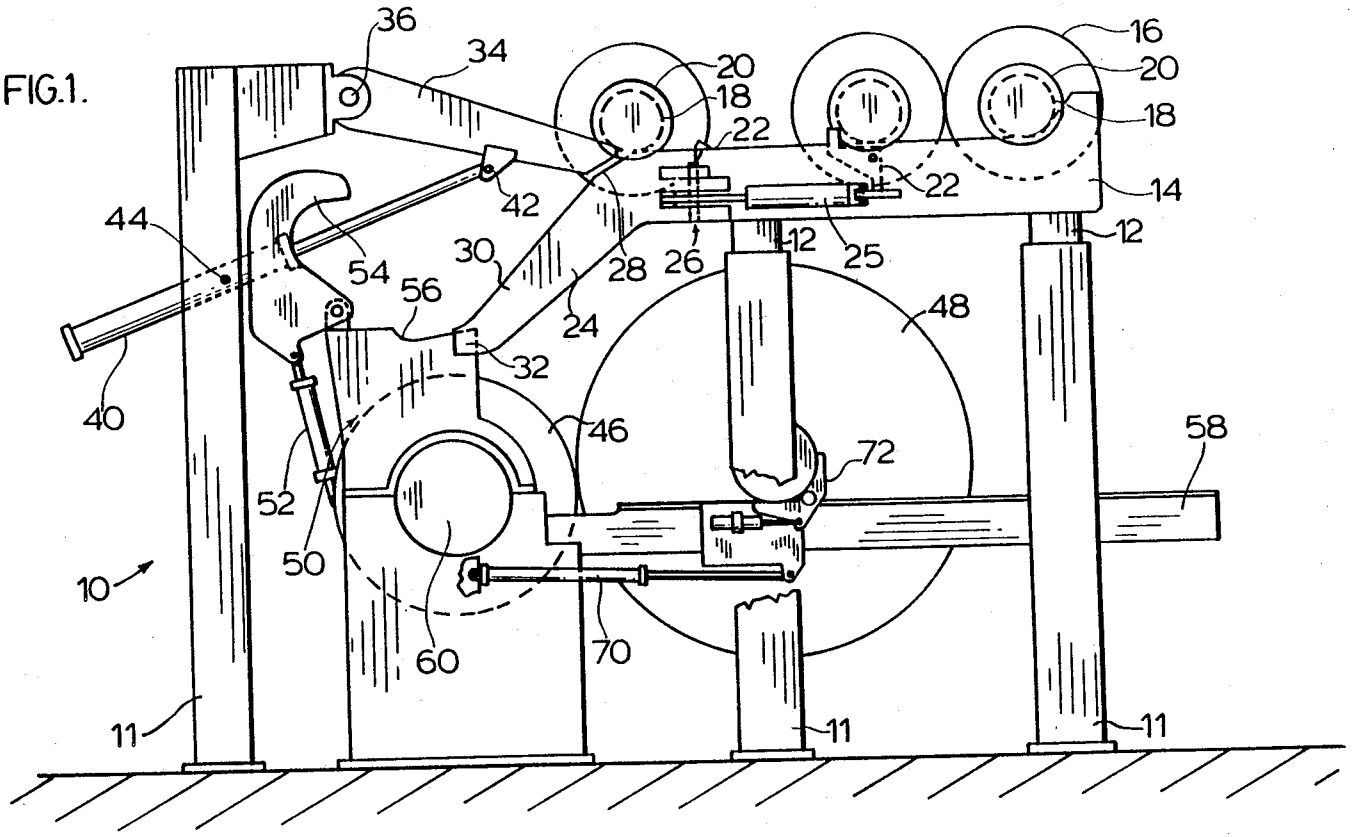
FIG. 1 is a schematic side elevation illustrating the reel bar loading mechanism with the second rails shown in their first operating position.

Referring to FIG. 1, there is shown generally at 10 a winding station for a paper making machine. The winding station comprises a plurality of support columns 11 and cross beams 12. Above the columns 12 on top of the beams 11 is supported a first pair of sloping racks or rails 14 are supported. It should be understood that while only one side of the winding station is illustrated, the other side of the station corresponds to the side described.

Figure 2:
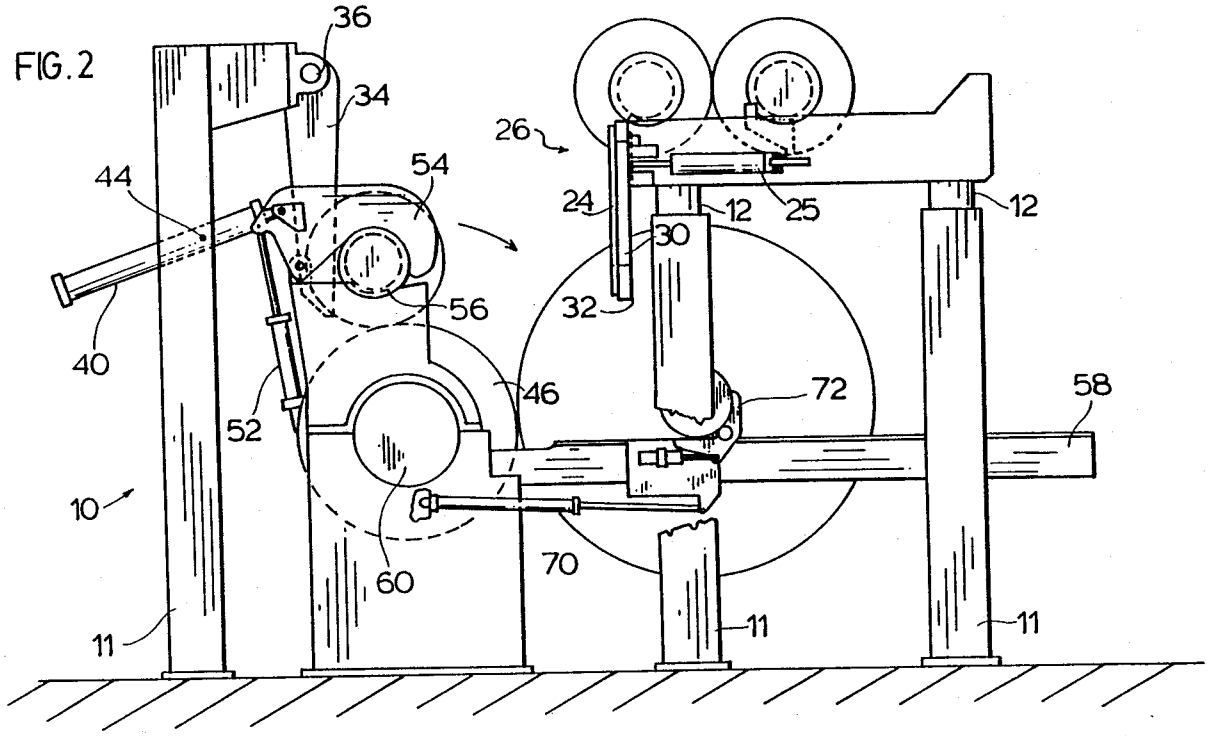
FIG. 2 is a schematic side elevation similar to FIG. 1 showing the second rails in their second position; and, FIG. 3 is a partial plan view showing the alignment of the first and second rails of the reel bar loading mechanism of the present invention.
Figure 3:
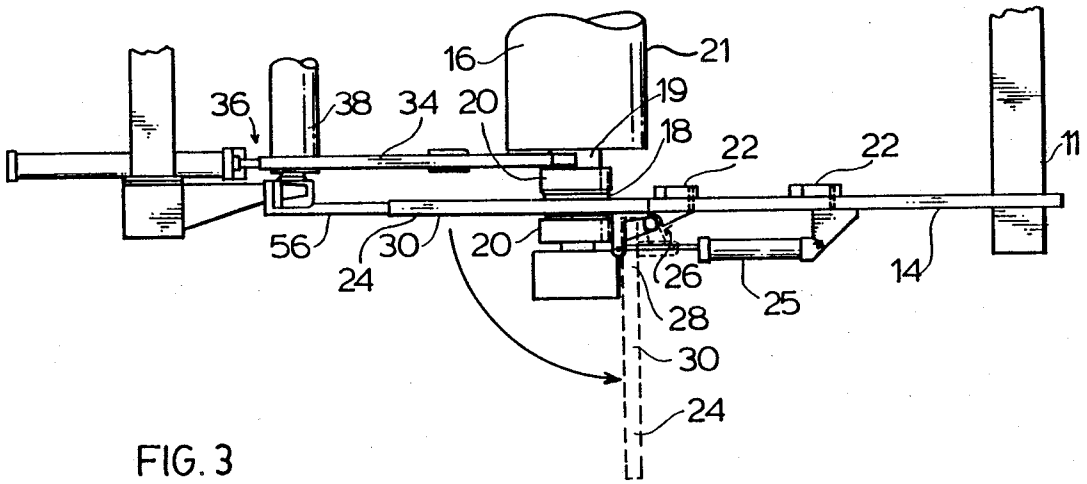

The rails 14 slope downwardly from the right side of FIGS. 1 and 2 at a predetermined angle of approximately 2° . The rails 14 are spaced apart to provide a track for supporting and guiding empty reels 16 prior to these reels being loaded into a winding position. The reels 16 are loaded onto the first rails 14 by a crane (not shown). In FIG. 3 each end of the reels includes a first groove 18 located between two collars 20 so as to provide a shoe that runs over and along a corresponding rail 14. The rails 14 have stops 22 located on an inside surface of the rails that pivot under piston control (not shown) to raise the stop into engagement with inner reel collar 20 to halt movement of the reel along the rails 14.

In FIG. 1 the lower ends of the first rails 14 are shown pivotally connected to second rails 24. The pivot connection is provided by a hinge 26 having hinge brackets attached to respective outside surfaces of rails 14 and 24. The hinge joint 26 pivots about a pin that is oriented along a vertical axis. The second rails 24 have an upper end portion 28, a downwardly sloping portion 30 and a lower end portion 32. In the position shown in FIG. 1 (the first position), the second rails 24 provide a continuum of the track provided by the first rails 14. This allows the shoes of the reels 16 to pass from the first rails 14 onto the second rails 30. The second rails 24 may be pivoted about the vertical axis with respect to the first rails 14 into a second position as shown in FIG. 2. In this second position for the second rails 24, the reels 16 are prevented from moving onto the second rails by the stops 22. Further due to the outward movement of the rails 24 at right angles to the rails 14, the rails 24 would effectively engage the outer collar 20 of the reel 16 in the event that the stop 22 does not function. It is envisaged that it would be feasible to have the rails 24 engage the outer collar 20 of the reel 16 simultaneously with the stop 22 engaging the inner collar 20 of the reel when the rails 14 are in their second outwardly pivoted position. Movement of the rails 24 relative to the rails 14 is controlled by a hydraulic piston and cylinder arrangement 25 with the cylinder pivotally connected to the outside surface of the rail 14 and the piston pivotally connected to the outside surface of the rail 24. The rails 24 are positioned in alignment with the rails 14 to provide a continuum of the track when the piston/cylinder arrangement is expanded and the rails 24 extend outwardly at right angles to the rails 14 when the piston/cylinder arrangement is contracted.

Movement of the reel 16 over the second rails 24 is controlled by a pair of lowering arms 34 (only one shown). The lowering arms 34 engage a respective groove 19 (see FIG. 3) located at an end of the reel 16 between the main body of the reel 21 and the inside collar 20 of the reel. The engagement of the lowering arms 34 in grooves 19 of the reel 16 effectively locates the lowering arms adjacent to and on the inside of second rails 24 so as to permit the second rails to pivot outwardly. The lowering arms 34 are pivotally connected at 36 to the supporting structure of the left-most column 11 shown in the drawings. The lowering arms are interconnected by an elongated bar or shaft 38 (FIG. 3) that spans the width of the station between the rails 14 and 22. Movement of lowering arms 34 is controlled by respective hydraulic piston and cylinder arrangements 40 shown pivotally connected to the lowering arm at 42 and to the column 12 at 44. The control of hydraulic pistons/cylinders 40 and the interconnection of the lowering arms 34 via bar 38 ensures that the ends of a reel 16 uniformly descend the second rails 24.

Below the second rails 24 is a driving roll 46. The driving roll contacts the reel 16 and drives the reel 16 as paper or web (not shown) is rolled onto the empty reel. It should be understood that a reel prestart device to start rotation of the reel prior to it contacting the driving roll 46 is not shown and that a cutting device to cut the continuous paper web from the wound roll 48 is not shown.

The reel 16 descends the rails 24 with groove 18 rolling onto a supporting shoe 56 of an awaiting transfer arm 50 (one located at each end of the reel). The transfer arm 50 includes a cylinder/piston arrangement 52 which is pivotally attached to a clamp or jaw 54. Transfer arm 50 further includes a lower jaw 51 pivotally movable by piston/cylinder arrangement 53. In FIG. 2, the cylinder/piston 52 is extended to pivot the jaw 54 about collar 20 and the piston/cylinder arrangement 51 is extended bringing the lower jaw 53 up into engagement with collar 20. Once the reel 16 has been initially loaded on the driving roll 46, the wound roll 48 moves out of the station 10 along lower rails 58. The reel 16 is supported by the shoe 56 and jaws 53 and 54 of the transfer arm mechanism 50. The transfer arm 50 subsequently rotates about axis 60 in the direction of arrow 61 thereby moving the reel 16 onto rails 58. The transfer mechanism controls the nip pressure between the reel and the driving roll 46. At this stage, the reel 16 is supported on lower rails 58. A piston cylinder mechanism 70 and shoe assembly 72 controls the nip pressure between the driving roll 46 and paper wound on reel 16. As the paper continues to wind on reel 16, the roll diameter increases, increasing the distance between the axis of drive roll 46 and reel 16. The piston/cylinder arrangements 51, 52 of transfer arm 50, contract pivoting jaws 53,54 out of engagement with collar 20 and transfer arm 50 is rotated back into the position shown in FIG. 1. The rails 24 are then pivoted back to the position shown in FIG. 1 and arms 34 are raised to ready the loader for the descent of the next reel 16.

In accordance with the present invention the transfer of the reel from the upper first rails 14 to the lower winding position is accomplished by first allowing the reel 16 to descend the rails 24 under the control of the lowering arms 34 and the piston/cylinder hydraulic arrangement 40. As a result, the load associated with the weight of the reel is shared by the rails 24 and lowering arms 34. The reel is lowered off the lower end portions of the rails 24 into the adjacent transfer arm 56. The piston/cylinders 51,52 are then expanded causing the jaws 53,54 to surround the collars 20 of the reel 16. At this time, the piston/cylinder 40 is contracted further so that the arms 34 no longer engage the reel. The rails 24 are then pivoted outwardly to their second position as shown in FIG. 2. This permits the transfer arm 56 to rotate about axis 60 maintaining the reel 16 in contact with the drive roll 46 and ultimately placing the reel on the rails 58.

What I claim as new and desire to secure by Letters Patent of the United States is:

1. A reel bar loader for loading a reel into winding position in a paper making machine, comprising:

first rail means including a pair of parallel first rails each of which gently slopes downwardly from one end towards the other end thereof and which together provide a track for carrying at least one reel;

second rail means including a pair of second rails each having an upper end portion, a downwardly sloping portion and a lower end portion, each of the upper end portions of the second rails being pivotally connected about a vertical axis to the other end of a corresponding one of the first rails;

transfer arm means being pivotally movable between a first loaded position adjacent the lower end portions of the second rails for accepting the reel from the lower end portions of the second rails and a second loaded position positioning the reel in a winding position remote from the lower end portions of the second rails;

means for controlling pivotal movement of the second rails in an outward direction away from one another from a first position, where the second rails are parallel to one another and are in alignment with the first rails providing a continuum of the track and allowing movement of the reel over the second rails into the transfer arm means, to a second position, where the second rails are in non-alignment with the first rails such that the lower end portions thereof are positioned remote of the transfer arm means precluding movement of a further reel over the second rails and permitting movement of the transfer arm means into the second loaded position which movement of the transfer arm means in loaded condition would otherwise be prohibited by the second rails when in their first position; and, means for controlling the descent of the reel as the reel moves over the second rails into the transfer arm means.

2. The reel bar loader of claim 1 wherein the means for controlling pivotal movement of the second rails comprises a hydraulic piston and cylinder for each second rail and corresponding pivotally connected first rail, the cylinder being pivotally secured to an outside surface of the first rail with the piston being pivotally secured to an outside surface of the second rail, contraction of the piston causing the second rail to pivot outwardly at an angle of about 90 degrees with respect to the first rail.

3. The reel bar loader of claim 1 wherein the means for controlling the descent of the reel over the second rail means comprises a pair of lowering arms positionable below opposing ends of the reel adjacent to and inside of the second rails and a means for moving the lowering arms in unison to lower the reel over the second rails into the transfer arm means.

4. The reel bar loader of claim 3 wherein the transfer arm means includes means for controlling the nip pressure between the reel and a driving roll during pivotal movement from the first loaded position to the second loaded position.

5. The reel bar loader of claim 4 wherein the transfer arm means includes opposing jaws adapted to partially surround a collar for the reel, and the nip pressure control means comprises tension control piston means connected to the jaws.

6. The reel bar loader of claim 1 wherein the reel includes two grooves at opposing end thereof and the transfer arm means includes supporting shoes providing tracks continuous with the lower end portions of the second rails whereby the grooves of the reel are able to roll over the first rails, second rails, and onto the shoe when the second rails are in its first position.

* * * * *